US011686499B1

(12) United States Patent
Sullins

(10) Patent No.: US 11,686,499 B1
(45) Date of Patent: Jun. 27, 2023

(54) APPARATUS AND METHOD FOR FRESH AIR COOLING OF A RESIDENCE OR BUILDING

(71) Applicant: Jason Sullins, Beaverton, OR (US)

(72) Inventor: Jason Sullins, Beaverton, OR (US)

( * ) Notice: Subject to any disclaimer, the term of this patent is extended or adjusted under 35 U.S.C. 154(b) by 0 days.

(21) Appl. No.: 17/842,705

(22) Filed: Jun. 16, 2022

(51) Int. Cl.

| | |
|---|---|
| ***F24F 11/88*** | (2018.01) |
| ***F24F 11/52*** | (2018.01) |
| ***F24F 11/63*** | (2018.01) |
| ***F24F 11/77*** | (2018.01) |
| ***F24F 110/10*** | (2018.01) |
| ***F24F 110/12*** | (2018.01) |

(52) U.S. Cl.
CPC ..... *F24F 11/88* (2018.01); *F24F 11/52* (2018.01); *F24F 11/63* (2018.01); *F24F 11/77* (2018.01); *F24F 2110/10* (2018.01); *F24F 2110/12* (2018.01)

(58) Field of Classification Search
CPC .. F24F 11/88; F24F 11/52; F24F 11/63; F24F 11/77; F24F 2110/10; F24F 2110/12
See application file for complete search history.

(56) References Cited

U.S. PATENT DOCUMENTS 5,267,897 A * 12/1993 Drees ..... F24F 7/08 73/861.04
2010/0082161 A1* 4/2010 Patch ..... F24F 11/46 236/49.3
2012/0296480 A1* 11/2012 Raman ..... G05D 23/1934 700/277
2014/0206278 A1* 7/2014 Stevenson ..... F24F 11/76 454/343
2017/0236766 A1* 8/2017 Read ..... H01L 23/32 439/373
2017/0363309 A1* 12/2017 Mills ..... F24F 13/14
2018/0038611 A1* 2/2018 Lau ..... F24D 19/1039
2020/0011555 A1* 1/2020 Mills ..... F24F 7/065
2021/0071888 A1* 3/2021 Mowris ..... F24F 11/88

* cited by examiner

*Primary Examiner* — Thomas C Lee
*Assistant Examiner* — Anzuman Sharmin
(74) *Attorney, Agent, or Firm* — Mohr Intellectual Property Law Solutions, PC

(57) ABSTRACT

A system and method for transporting cool fresh outside air into an occupied quarters which has an interface member, input connectors, output connectors, switches, and a microcontroller controllably coupled to the plurality of switches. When the thermostat controller system is operating during a heating period, the switches are closed by the microcontroller such that the thermostat controller system controls the operation of the remote air-handling unit that heats air provided to an occupied quarters. When the thermostat controller system is operating during a cooling period, the switches are opened by the microcontroller such that the thermostat controller system no longer controls the operation of the remote air-handling unit when a temperature of outside air is at least less than a cooling set point. The microcontroller operates a remote fan to draw the outside air into the occupied quarters when the outdoor air temperature is less than the cooling set point.

18 Claims, 7 Drawing Sheets

APPARATUS AND METHOD FOR FRESH AIR COOLING OF A RESIDENCE OR BUILDING

BACKGROUND OF THE INVENTION

Residence and building cooling during periods of warm weather is typically performed by an air conditioning (AC) unit or a heating, ventilation, and air conditioning (HVAC) system. The use of AC to cool buildings is one of the fastest growing uses of energy and can result in high costs to the residents, tenants of the building, and/or the building owners.

In many climates, evening, nighttime, and early morning ambient temperatures may be relatively cool. Moving the cool ambient air into the residence or building may be a very desirable way to cool the residence. However, there may be no practical way to efficiently transport cool ambient outside air into the residence.

Often, the resident will open one or more windows to let the cool air into the residence. Fans may be employed to assist in the movement of cool air into the residence or building. However, open windows may lead to safety and security issues. Furthermore, opening windows and turning on fans is tedious and inaccurate as it must be performed manually by the resident.

Accordingly, in the arts of residence air conditioning, and in particular the arts of thermostat controllers, there is a need in the arts for improved methods, apparatus, and systems for moving cool air into a residence.

SUMMARY OF THE INVENTION

Embodiments of the fresh air cooling and ventilator (FACVFACV) controller provide a system and method for transporting cool fresh outside air into an occupied quarters. One embodiment has an interface member, input connectors, output connectors, switches (solid-state or electromechanical), and a microcontroller that is controllably coupled to the plurality of switches. When the thermostat controller system is operating during a heating period, switches are closed by the microcontroller such that the FACV controller is transparent to the HVAC operation, and the thermostat controller system controls the operation of the remote air-handling unit that heats air provided to an occupied quarters. When the thermostat controller system is operating during a fresh air cooling period, the switches are opened by the microcontroller such that the thermostat controller system no longer controls the operation of the remote air-handling unit when the temperature of outside air is at least less than a cooling set point. The microcontroller operates a remote fan(s) to draw the outside air into the occupied quarters when the temperature of outside air is less than the cooling set point.

BRIEF DESCRIPTION OF THE DRAWINGS

The components in the drawings are not necessarily to scale relative to each other. Like reference numerals designate corresponding parts throughout the several views.

DETAILED DESCRIPTION

Figure 1:
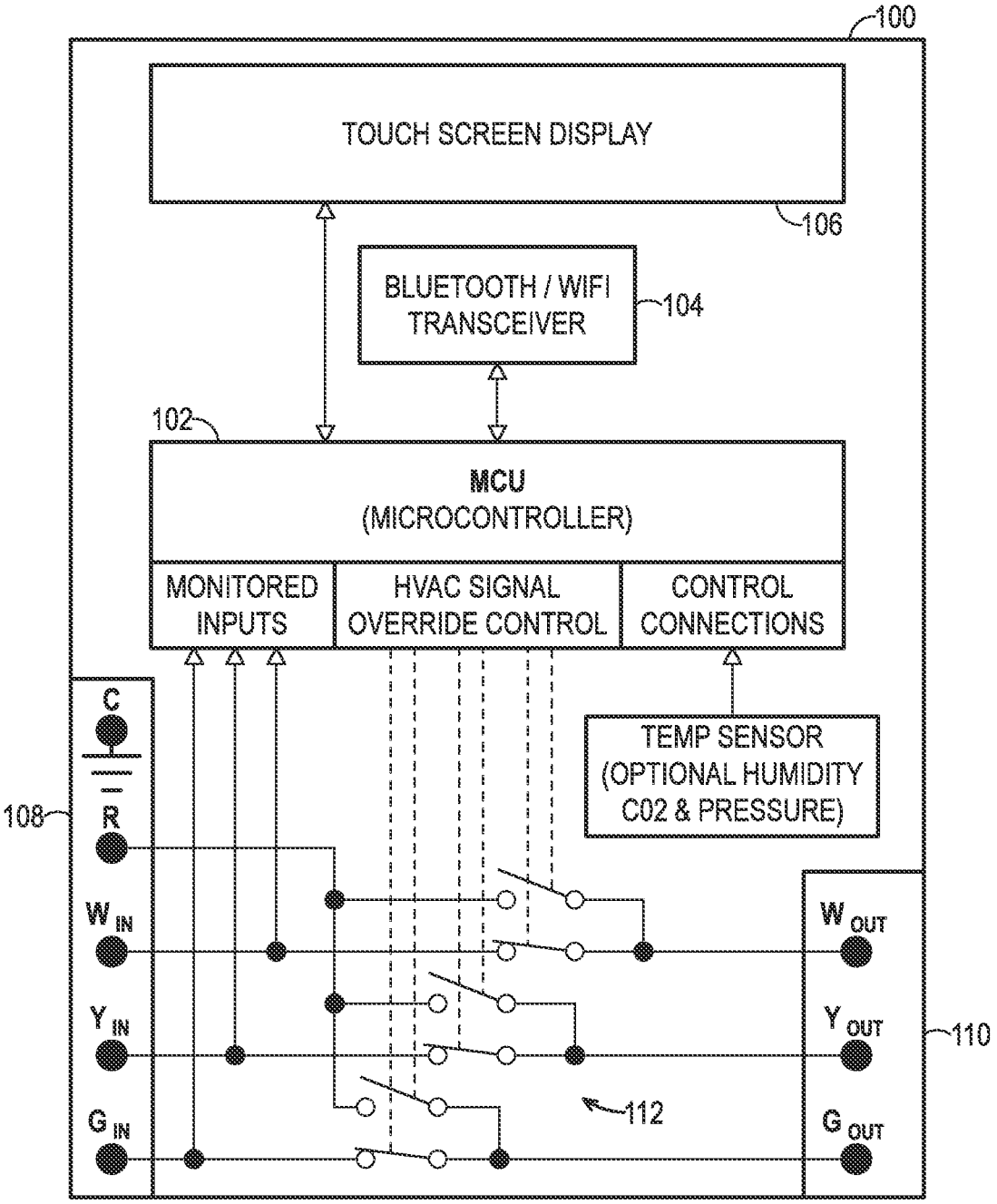
FIG. 1 is a block diagram of a fresh air cooling and ventilator (FACV) controller.

FIG. 1 is a block diagram of a fresh air cooling and ventilator (FACV) controller 100. Embodiments of the FACV controller 100 comprise a microcontroller 102, an optional transceiver 104, an optional touch screen display 106, a plurality of input connectors 108, a plurality of output connectors 110, and a plurality of controllable switches 112. Some embodiments may include an optional temperature sensor, a humidity sensor, and/or a $CO_2$ sensor 114.

Figure 2:
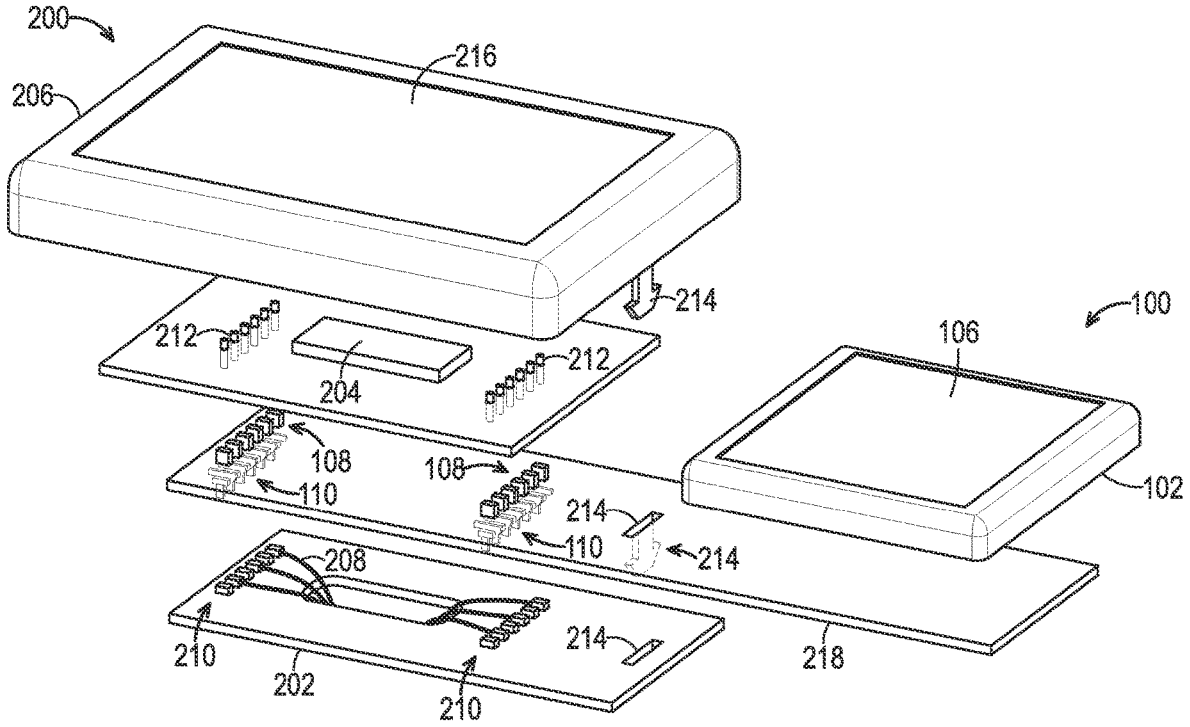
FIG. 2 is an exploded diagram of an FACV controller connected to a thermostat controller system through an interface adapter board.

FIG. 2 is an exploded diagram of an FACV controller 100 and a thermostat controller system 200. The FACV controller 100 is configured to controllably couple to the thermostat controller system 200.

As is understood in the art of thermostat controllers, thermostat controller system 200 typically comprises three elements; a wall plate 202 (or base plate), a thermostat controller 204, and a cover plate 206 (which may house the thermostat controller). During installation, the installer secures the wall plate 202 onto the surface of a wall. Control wires 208 extend through the structure, are accessible to the installer via a hole in the wall behind the cover plate 206, and are coupled to the AC or HVAC unit. The installer connects the control wires 208 to wall plate terminals 210 disposed on the outside surface of the wall plate 202 so that the thermostat controller system 200 becomes controllably coupled to the AC or HVAC unit (both are interchangeably referred to herein as an air-handling unit).

The legacy thermostat controller 204 has connecting terminals 212 that correspond to the terminals 210 of the wall plate 202. The wall plate terminals 210 and the controller connecting terminals 212 are co-located so that when the thermostat controller 204 is installed onto the wall plate 202, the thermostat controller connecting terminals 212 and the wall plate terminals 210 are in electrical contact with each other. Accordingly, the thermostat controller 204 is controllably coupled to the AC or HVAC unit (via the control wires).

To complete the installation of the thermostat controller system 200, the installer couples the cover plate 206 (that is housing the thermostat controller 204 in the interior of the cover plate 206) to the wall plate 202. Typically, the cover plate 202 is secured to the wall plate using screws, bolts, clips, snaps, latches or other securing means 214.

Once installed, the resident (interchangeably referred to herein as a building tenant or a user) may operate the thermostat controller system 200 to regulate indoor temperatures to desired temperature values that have been specified by the resident using their thermostat controller system 200. Typically, legacy thermostat controller systems 200 have a user interface where the user may specify desired room temperatures for different times of the day and/or different days of the week. Often, the user interface is a touch-sensitive display 216. However, any thermostat controller system 200 with any type of user interface may be suitable for embodiments of the FACV controller.

Embodiments of FACV controller 100 are configured to be coupled, in an intervening manner, between the thermostat controller 204 and the wall plate 202. In a preferred embodiment, the input connectors 108 and the output connectors 110 are disposed on opposing sides of a proximal end of an interface member 218. In such embodiments, the touch screen display 106 (and its housing, which may include the microcontroller 102 and/or the transceiver 104) are disposed on a distal end of the interface member 218, preferably on the same side of the interface member 218 as the input connectors 108.

The input connectors 108 of the FACV controller 100 correspond to the thermostat controller connecting terminals 212 both in location and control functionality. The output connectors 110 of the FACV controller 100 correspond to the wall plate terminals 210 both in location and functionality. Accordingly, when the FACV controller 100 is secured to a legacy thermostat controller system 200 in an intervening manner between the wall plate 202 and the thermostat controller 204 (for example, but not limited to, via interface member 218), the FACV controller 100 then has the capability to override control of the thermostat controller system 200.

Figure 3:
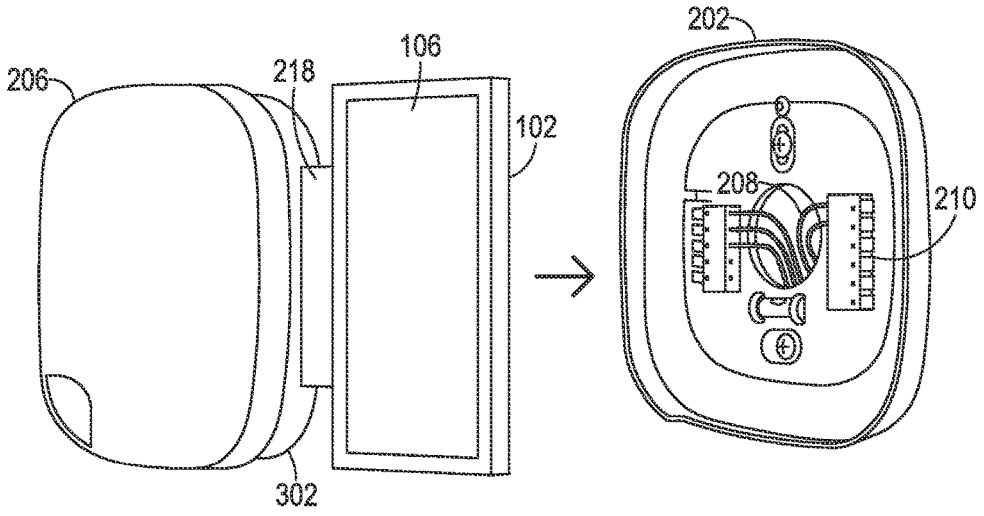
FIG. 3 is a block diagram of an embodiment of the FACV controller that is specially configured to couple to a brand-name thermostat controller system.

FIG. 3 is a block diagram of an embodiment of the FACV controller 100 that is specially configured to couple to a brand-name thermostat controller system 200. One skilled in the art appreciates that there are a variety of different brands of thermostat controller systems 200. Each thermostat controller system 200 will have a different appearance as defined by the company that manufactures each particular thermostat controller system 200. Accordingly, various embodiments of the FACV controller 100 are available that are specially tailored to couple to a particular thermostat controller system 200.

The resident only needs to identify the manufacturer, brand, and/or model number of their residential thermostat controller system 200. The resident then acquires a corresponding FACV controller 100 that is tailored for their particular thermostat controller system 200. More particularly, the interface member 218 is tailored to couple to the particular thermostat controller system 200. The specially tailored interface member 218 will have its input connectors 108 and output connectors 110 correspond to the wall plate terminals 210 and the thermostat controller connecting terminals 212 of the resident's particular thermostat controller system 200 both in location and functionality.

To install the tailored FACV controller 100, the resident initially separates the cover plate 206 (with the thermostat controller 204 therein) from the wall plate 202. The lower side of the interface member 218 includes a securing means 214 that is the same as (that is, corresponds to) the securing means 214 used to secure the cover plate 206 to the wall plate 202. Here, the resident simply secures the bottom side of the interface member 218 to the wall plate 202. Accordingly, the output connectors 110 are then in electrical contact with the corresponding wall plate terminals 210 of the resident's thermostat controller system 200.

The top surface of the interface member 218 includes a securing means 214, which is the same as the securing means 214 on the wall plate 202 that is used to secure the cover plate 206 to the wall plate 202. The resident then secures the cover plate 206 (with the thermostat controller 204 therein) to the top surface of the interface member 218 by coupling the securing means 214 of the cover plate 206 to the corresponding securing means 214 on the interface member 218. Installation of the FACV controller 100 is then completed. The FACV controller 100 can then be initialized and placed into operation (see FIGS. 7A-7B).

Preferably, a portion of the interface member 218 includes a cover member 302 that hides all of, or a portion of, the interface member 218 (and the associated connectors 108 and terminals 210, 212) from view. The cover member 302 portion may be shaped similar to, or the same as, the perimeter of the cover plate 206. The cover member 302 may optionally have the same color as the cover plate 206. When the installed FACV controller 100 is viewed by the resident, the resident perceives that the installed FACV controller 100 appears to be part of, or intentionally integrated with, the original thermostat controller system 200.

Further, the FACV controller 100 has the capability of controlling other air-handling devices as disclosed herein. Accordingly, when cool air that is typically available during the night or early morning is available, the FACV controller 100 is able to control the operation of the AC or HVAC system (the air-handling system) and concurrently operate other air-handling devices, to bring fresh cool outside air into the residence in a controlled manner.

The disclosed systems and methods for an FACV controller 100 will become better understood through a review of the following detailed description in conjunction with the figures. The detailed description and figures provide examples of the various inventions described herein. Those skilled in the art will understand that the disclosed examples may be varied, modified, and altered without departing from the scope of the inventions described herein. Many variations are contemplated for different applications and design considerations, however, for the sake of brevity, each and every contemplated variation is not individually described in the following detailed description.

Throughout the following detailed description, a variety of examples for systems and methods for using a fresh air cooling and ventilator (FACV) controller 100 are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

The following definitions apply herein unless otherwise indicated.

"Substantially" means to be more-or-less conforming to the particular dimension, range, shape, concept, or other aspect modified by the term, such that a feature or component need not conform exactly. For example, a "substantially cylindrical" object means that the object resembles a cylinder, but may have one or more deviations from a true cylinder.

"Comprising," "including," and "having" (and conjugations thereof) are used interchangeably to mean including but not necessarily limited to, and are open-ended terms not intended to exclude additional elements or method steps not expressly recited.

Terms such as "first," "second," and "third" are used to distinguish or identify various members of a group, or the like, and are not intended to denote a serial, chronological, or numerical limitation.

"Coupled" means connected, either permanently or releasably, whether directly or indirectly through intervening components. "Secured to" means directly connected without intervening components.

"Communicatively coupled" means that an electronic device exchanges information with another electronic device, either wirelessly or with a wire-based connector, whether directly or indirectly, through a communication network. "Controllably coupled" means that an electronic device controls the operation of another electronic device.

Figure 4:
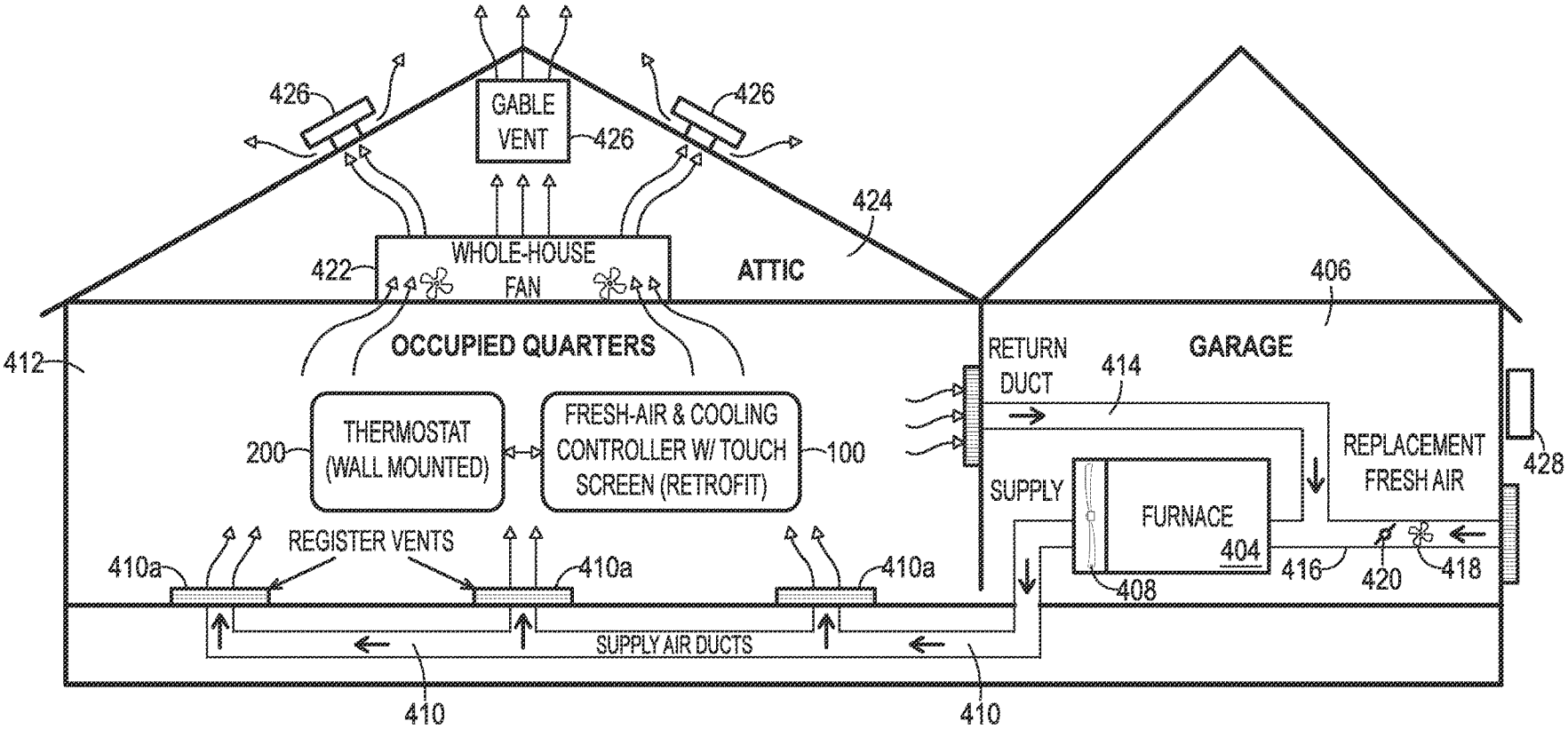
FIG. 4 is a conceptual diagram of a residence with an installed FACV controller.

FIG. 4 is a conceptual diagram of a residence 400 with an installed FACV controller 100. The installed FACV controller 100 is controllably coupled to a wall-mounted thermostat controller system 200. The arrowed lines conceptually denote the directional flow of air through the residence 400, wherein the arrowhead indicates the direction of airflow.

During an interior space heating period, the thermostat controller 204 generates a heating command that is communicated, via the FACV controller 100, to the furnace 404 of the HVAC unit. The remote furnace 404 (remote air-handling unit) is conceptually illustrated as residing in the garage 406 and is remotely located from the thermostat controller system 200. Alternatively, the furnace 404 may reside in a remotely located furnace room (not shown) of the residence 400.

The furnace 404 (using natural gas, oil, solar power, or electricity) heats the air within the furnace 404. The furnace fan 408 then operates to transport the heated air from the furnace 404 through the supply air ducts 410 that are ducted out to various regions of the residence 400. The heated air then exits out into the occupied quarters 412 of the residence 400 through register vents 410*a* that are fluidly coupled to the distal ends of the supply air ducts 410 to the occupied quarters 412. Air from the occupied quarters 412 is then transported back to the furnace 404, via one or more return ducts 414, for reheating. During the heating period, warmed air is continuously circulated between the furnace 404 and the occupied quarters 412 to maintain the temperature within the occupied quarters 412 at a temperature value that has been set at the thermostat controller system 200.

The furnace 404 receives external fresh air, from time to time and/or in relatively small amounts. The replacement fresh air enters into the residence 400 via a fresh air duct 416. An optional fresh air intake fan 418 may be used to transport the fresh air into the fresh air duct 416. If fresh air is not needed, a damper 420 may be used to block the flow of fresh air through the fresh air duct 416. In some residences 400, the damper 420 may be controlled by a motor and control system to open and close to facilitate control of fresh intake air into the furnace 404.

Some residences 400 may include one or more whole-house fans 422 (interchangeably referred to herein as an attic fan 422) that, when operated, transports air from the occupied quarters 412 into the attic 424. The whole house fan(s) 422 can also be installed to exhaust hot air from the occupied quarters 412 directly outside of the home or building into the exterior air, with the primary objective being to evacuate hot interior air out of the living quarters and pull cool air into the living quarters through the HVAC supply air ducts 410. In addition to cooling the air within the occupied quarters 412, the thermal mass of the building structure 400 itself is cooled, which serves as a temperature storage element that continues to keep the occupied quarters 412 cool as external temperatures increase during the day. In some situations, the resident may choose to install one or more whole-house fans 422 so that an embodiment of the FACV controller 100 may be installed at their residence.

Typically, a whole-house fan 422 is operated by the resident who manually actuates a manual fan control switch (not shown). For example, the resident may understand that the temperature of the outside fresh air is cooler than the air within the occupied quarters 412. The resident may decide to manually operate the whole-house fan 422 to draw out warm air from the occupied quarters 412 into the attic 424 (or directly to the outside environment). The air may then flow out of the attic 424 through roof vents 426 or gable vents 426. As air is transported out from the occupied quarters 412, the negative air pressure created by the operating whole-house fan 422 draws fresh air into the occupied quarters 412 from the external ambient environment that is outside of the residence 400. For example, the resident may manually open a door and/or window so that the cooler outside fresh air may enter from the outside environment into the occupied quarters 412.

In the illustrative application of an embodiment of the FACV controller 100 that has been installed in the residence 400, the FACV controller 100 is controllably coupled to the whole-house fan 422. Preferably, the FACV controller 100 is communicatively coupled to an outdoor temperature sensor 428 that senses ambient temperature outside of the residence 400. Alternatively, or additionally, the sensor 428 may be configured to sense outdoor humidity and/or outdoor $CO_2$ levels. Also, the FACV controller 100 preferably receives information corresponding to the temperature of the air within the occupied quarters 412 from the thermostat controller system 200 or the optional temperature sensor 114 (FIG. 1).

Assuming that the resident has set the thermostat controller system 200 or the FACV's microcontroller 102 to a low-temperature setting during the nighttime or morning periods, the microcontroller 102 continuously compares the outside temperature with the specified cool temperature setting. When the temperature of the outside air is less than the cool air temperature setting (interchangeably referred to herein as a cooling set point), preferably by some predefined threshold, the FACV's microcontroller 102 generates an actuation signal that is configured to turn on (activate) the whole-house fan 422. The actuation signal may be wirelessly transmitted to the whole-house fan 422, via the transceiver 104, or may be transmitted by a wire-based signal (when a conductor is used to controllably couple the microcontroller 102 to the whole-house fan 422).

As the cooler air from outside is drawn into the occupied quarters 412, the air temperature within the occupied quarters 412 decreases. When the temperature decreases to the cooling set point temperature, or preferably within some predefined temperature threshold, the microcontroller 102 generates a deactivation signal that is communicated to the whole-house fan 422. In response to receiving the deactivation signal, the whole-house fan 422 turns off (deactivates).

In embodiments where an AC system is being used to control the temperature within the occupied quarters 412 of the residence 400, the FACV controller 100 may be configured to deactivate the AC system while the whole-house fan 422 is operating to draw in the cooler outside fresh air. When the temperature of the outside air is higher than the specified temperature setting, the thermostat controller system 200, via the FACV controller 100, may operate the AC system to cool the air in the occupied quarters 412. Here, the control AC system signals generated by the thermostat controller system 200 are passed through the FACV controller 100 to the AC system.

Additionally, or alternatively, the microcontroller 102 may be controllably coupled to the furnace fan 408 and/or the fresh air duct 416. The cooler temperature outside air can then be drawn in through the fresh air duct 416, passed through the air-handling system of the furnace 404, and transported into the occupied quarters 412 via the supply air ducts 410. Depending upon the embodiment, the microcontroller 102 may be controllably coupled to the fans 408 and 418 using wireless signals or a wire-based connector. Further, if the damper 420 is controllable to be in an open or a closed position, the microcontroller 102 may be controllably coupled to the damper 420, using wireless signals or a wire-based connector, so that the damper 420 can be opened to permit passage of the cool outside air into the fresh air duct 416.

Figure 5:
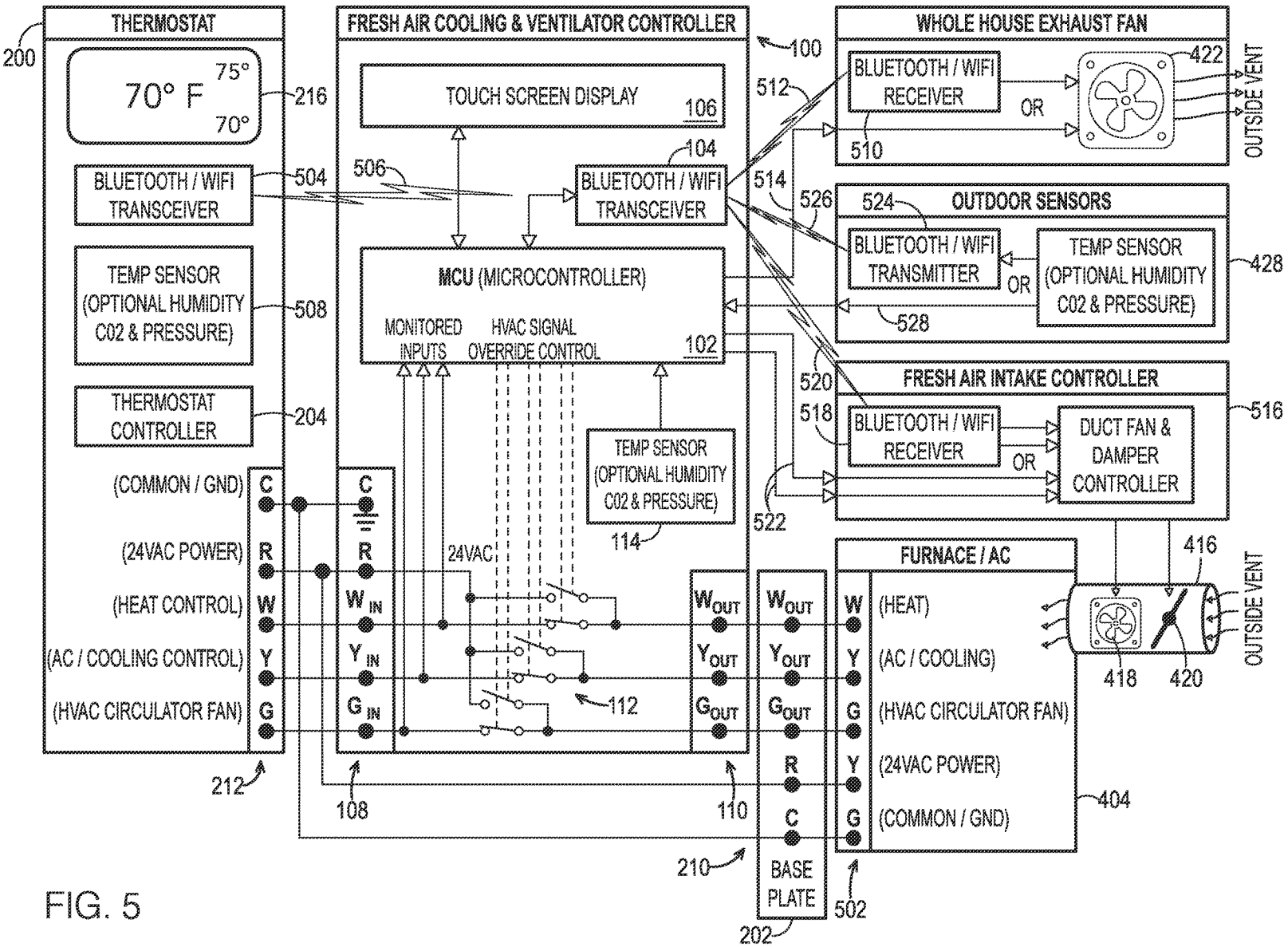
FIG. 5 is a block diagram of an FACV controller that is controllably coupled to a thermostat controller system, the whole-house exhaust fan, the furnace fresh air intake fan, the duct, and an outside temperature sensor.

FIG. 5 is an electrical block diagram showing connections of a non-limiting example FACV controller 100 that is controllably coupled to a particular thermostat controller system 200, the whole-house exhaust fan 422, the furnace fresh air intake fan 418, the duct 420, and an outdoor temperature sensor 428. The particular thermostat controller system 200 located at the residence 400 uses terminal connections C, R, W, Y, and G to control the furnace 404.

When the FACV controller 100 has been installed in an intervening manner between the wall plate 202 and the thermostat controller 204, the connections C, R, W, Y, and G of the thermostat controller connecting terminals 212 are in electrical contact with the input connectors 108 (denoted as $C_{in}$, $R_{in}$, $W_{in}$, $Y_{in}$, and $G_{in}$). Similarly, the connections $W_{out}$, $Y_{out}$, and $G_{out}$ of the output connectors 110 are electrically connected to the W, Y, and G terminals 210 of the wall plate 202. The corresponding terminals 502 of the furnace 404 remain connected to the corresponding wall plate terminals 210 via the control wires 208, which do not need to be modified during the installation process of the FACV controller 100. Further, the common/ground connector (C) and the twenty-four-volt alternating current (24 VAC) connector (R) are electrically connected to the corresponding terminals of the thermostat controller 204, to the controllable switches 112, to the terminals of the wall plate 202, and to the furnace terminals 502 at the furnace 404.

In those embodiments, wherein the thermostat controller system 200 includes a transceiver 504, the transceiver 104 of the FACV controller 100 may be communicatively coupled to and/or controllably coupled to the transceiver 504 of the thermostat controller system 200 via a wireless signal 506. For example, the microcontroller 102 may be configured to issue operating commands to the thermostat controller 204 (since the operational characteristics of the particular thermostat controller system 200 are known beforehand). When the FACV controller 100 is operating to draw fresh, cool outside air into the occupied quarters 412, the microcontroller 102 may issue a command to the thermostat controller 204 that deactivates the HVAC cooling system. As another non-limiting example, a temperature sensor 508 in the thermostat controller 204 may communicate temperature information corresponding to the air temperature in the occupied quarters 412 to the microcontroller 102.

As noted herein, the FACV controller 100 may be configured to controllably couple to other air-handling devices, such as the whole-house fan 422. If the whole-house fan 422 includes a wireless receiver 510, or is retrofitted with a wireless receiver 510, a wireless signal 512 communicated from the microcontroller 102 may turn on (activate) or turn off (deactivate) the whole-house fan 422 to cool the residence 400 using the cool outside fresh air. Alternatively, a wire connector 514 that controllably couples the microcontroller 102 to the whole-house fan 422 may be used to control the operation of the whole-house fan 422.

Alternatively, or additionally, if the fresh air intake fan 418 and/or the damper 420 are controlled by a fresh air intake controller 516 that includes a wireless receiver 518, or is retrofitted with a wireless receiver 518, a wireless signal 520 communicated from the microcontroller 102 may turn on (activate) or turn off (deactivate) the fresh air intake fan 418 and/or open/close the damper 420 to facilitate cooling of the residence 400 using the cool outside fresh air. Alternatively, operations of these components may be controlled by the wire connectors 522 that controllably couples the microcontroller 102 to the fresh air intake fan 418 and/or the damper 420.

Preferably, the outdoor temperature sensor 428 includes a wireless transmitter 524 that communicatively couples the outdoor temperature sensor 428 with the microcontroller 102. Here, a wireless signal 526 may communicate the sensed outdoor temperature to the microcontroller 102. Alternatively, a wire connector 528 that communicatively couples the microcontroller 102 to the outdoor temperature sensor 428 may be used to provide outdoor temperature information to the microcontroller 102.

To conceptually illustrate the operation of the FACV controller 100, consider the operation of the FACV controller 100 and the thermostat controller system 200 during a heating period. During a heating period, the normally closed switches 112 of the FACV controller 100 would remain closed to the Y, W, and G terminals 212 of the thermostat controller 204 and would be controllably coupled to the corresponding terminals of the furnace 404. The thermostat controller system 200 would then operate as it would autonomously in accordance with heating set points specified by the resident.

During a fresh air cooling period, the W, Y, and G switches 112 would be opened so that the thermostat controller system 200 could not control the furnace 404. The microcontroller 102 would then generate activation signals to the fans 422, 418, and/or 408 to transport fresh cool air from outside into the occupied quarters 412.

If the thermostat controller system 200 controlled an AC system, the corresponding AC terminal switches 112 (shown in FIG. 5) would be opened when the temperature of the outside air was less than the FACV's set point temperature. Alternatively, or additionally, the AC terminal switches 112 could be opened when the temperature of the outside air was greater than the FACV's set point temperature, but less than the current indoor air temperature. Here, the cooler outside air would be used to initially cool the indoor air, and when the indoor air temperature drops to the current outdoor air temperature (by some predefined threshold), the AC system could then be operated to further cool the indoor air. This would prevent the thermostat controller system 200 from turning on the AC system, thereby allowing the outside cool fresh air to more economically cool the residence. The microcontroller 102 would then generate activation signals to the fans 422, 418, and/or 408 to transport fresh cool air outside into the occupied quarters 412.

Figure 6:
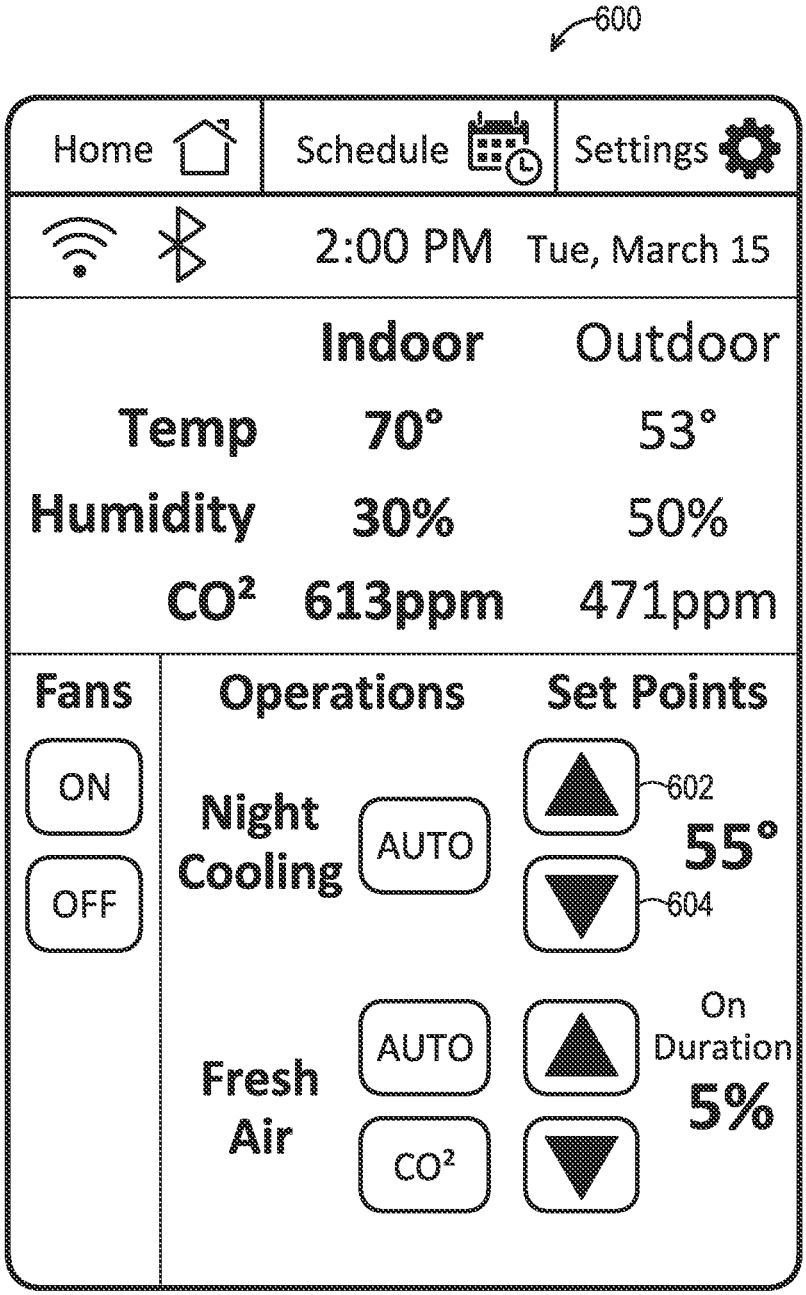
FIG. 6 is a conceptual illustration that is presented on the touch screen display of the FACV controller.

FIG. 6 is a conceptual illustration 600 that is presented on the touch screen display 106 of the FACV controller 100. The presented information indicates current indoor conditions (70° temperature, 30% humidity, and $CO_2$ level of 613 PPM) and current outdoor condition (55° temperature, 50% humidity, and $CO_2$ level of 471 ppm).

The information presented on the touch screen display 106 further indicates that for night cooling, a 55° Fahrenheit (F) set point temperature has been specified by the resident.

This 55° F. specification for a desired indoor temperature of 55° F. may have been made by the resident using the touch screen display 106, the display 216 of the thermostat controller system 200, and/or using another electronic device, such as a smartphone, a computer interface, or the like. Information provided by the outdoor temperature sensor 428 indicates that the outdoor temperature is currently at 53° F. (which is less than the cooling set point of 55° F., or is less than the set point of 55° F. by some predefined threshold. Accordingly, the FACV controller 100 will operate as described herein to bring fresh cool outside air into the residence 400 until either the indoor temperature drops below the set point of 55° F. plus an optional predefined threshold (3° F., for example), or until the outdoor temperature increases the set point of 55° F. plus an optional predefined threshold.

Touch-sensitive graphical icons may be presented on active regions (interchangeably referred to herein as a hot spot region) of the touch screen display 106 enabling the resident to make changes to the set points. For example, the resident may tap (touch with their finger) the graphical icon 602 to increase the temperature of the night cooling set point of 55° F. Alternatively, the resident may tap the graphical icon 604 to decrease the night colling set point of 55° F.

Some embodiments of the FACV controller 100 may be configured to display connectivity to other devices and/or indicate the communication format (e.g., Wi-Fi, Bluetooth, etc.) using commonly understood graphical icons. Additionally, or alternatively, outdoor temperature, humidity, and/or $CO_2$ levels, which are detected by the sensor 428 (FIG. 4) may be presented on the touch screen display 106. Additionally, or alternatively, the status of the remote fans that are controlled by the FACV controller 100 may be indicated on the touch screen display 106. Active regions on the touch screen display 106 may be provided to enable manual control of the fans by the resident for on-demand ventilation. Additionally, or alternatively, the operational status of the FACV controller 100 may be indicated. For example, but not limited to, the operational status of the FACV controller 100 to bring in fresh cool air may be indicated ("ON", "OFF", "AUTO"), and/or operational status to adjust $CO_2$ levels.

Some embodiments may be configured to provide a scheduling routine that enables the resident to control the operation of the FACV controller 100 on specific days and/or during specific hours. Some embodiments may present a current time, current day, and/or current date, to facilitate use of the scheduling routine.

Preferably, embodiments of the FACV controller 100 are configured to display the cooling set point (here, at 55° F.). Active regions may be included on the touch screen display 106, with intuitive graphical icons, that enable the resident to adjust the cooling set point upward or downward.

Additionally, or alternatively, some embodiments may be configured to display a ventilation duty cycle set point (5% on duration). This ventilation duty cycle number represents the percentage of time the remote fans are activated for fresh air ventilation when the FACV controller 100 is operating in the automatic mode. For example, a 5% ventilation duty cycle set point will run the fans for three minutes every hour. The ventilation duty cycle may be set by the resident, in an example embodiment, using the scheduling routine. Additionally, or alternatively, the touch screen display 106 may include active regions, with intuitive graphical icons, that enable the resident to adjust the ventilation duty cycle set point upward or downward.

As noted herein, some embodiments of the FACV controller 100 may not employ the optional touch screen display 106. In such embodiments, the FACV controller 100 may be configured to communicatively couple to a remote electronic device, such as a smartphone, a, computer interface, or the like. Some or all of the information illustrated in FIG. 6, or other supplemental information, may be presented on the touch screen display of the resident's remote electronic device, computer graphical interface with mouse-selectable controls, or web-based interface. When the remote electronic device is a smartphone, the transceiver 104 may be configured to communicatively couple to the smartphone using a Wi-Fi signal, a Bluetooth signal, a cellular signal, or another suitable wireless format. Here, the resident may be able to adjust the various set points of the FACV controller 100 and/or the thermostat controller system 200 using their smartphone.

An alternative embodiment of the FACV controller 100 is manually connected using low-voltage thermostat signal wires (instead of the interface member 218) to make the necessary HVAC signal wiring interconnections between the FACV 100, the thermostat controller 200, and the furnace 404. In this embodiment, the FACV 100 is mounted to the wall independently alongside the thermostat controller 200 but not physically connected. The thermostat controller 200 and the FACV 100 are installed with a hole in the wall behind each mounting plate, through which the thermostat wire is used to make the connections between these two devices and the furnace/AC 404. This installation option provides the same effective setup as the embodiment, which employs the interface member 218, with the reduced cost of not requiring the interface member 218 but requires a little more installation effort to connect the HVAC wires manually. FIG. 5 shows the necessary HVAC signal wire connections between HVAC signal connectors 212, 108, 110, and 212

Another alternative embodiment of the FACV controller 100 does not employ the interface member 218. Instead, a plurality of thin, flexible wire connectors (individual connectors or connectors disposed on a film) are used to connect the input connectors 108 and the output connectors 110 of the FACV controller 100 to the corresponding wall plate terminals 210 and controller connecting terminals 212 of the thermostat controller system 200. During installation, the installer separates the cover plate 206 and the wall plate 202, couples the input connectors 108 and the output connectors 110 of the FACV controller 100 to the corresponding wall plate terminals 210 and controller connecting terminals 212, and then secures the cover plate 206 back onto the wall plate 202. An unexpected advantage of this alternative embodiment is that a single "universal" FACV controller 100 may be operable to control a plurality of different thermostat controller systems 200.

If the touch screen display 106 is employed, the FACV controller 100 with the touch screen display 106, the microcontroller 102, and the transceiver 104 may be secured to the wall adjacent to the thermostat controller system 200. Alternatively, if user input is received from a different electronic device, such as the resident's smartphone, the display 106 may be omitted. Here, the microcontroller 102 and transceiver 104 may be stowed away within the interior of the thermostat controller system 200 and/or tucked behind the wall through the hole behind the cover plate 206.

Alternatively, if the microcontroller 102 and transceiver 104 cannot be conveniently stored within the thermostat controller system 200 and/or behind the wall, a suitable cover member 302 may be employed between the wall plate 202 and the cover plate 206 to hide the microcontroller 102 and transceiver 104. In practice, a universal FACV controller 100 may include a plurality of different types, shapes, and/or colors of cover members 302. The installer can then choose the best-suited cover member 302 to use with the thermostat controller system 200 that is being used. The unused cover members 302 may be discarded. Providing a plurality of different cover members 302 in a purchased package is not cost-prohibitive since each different cover member 302 can be produced at a very low cost.

Figure 7A:
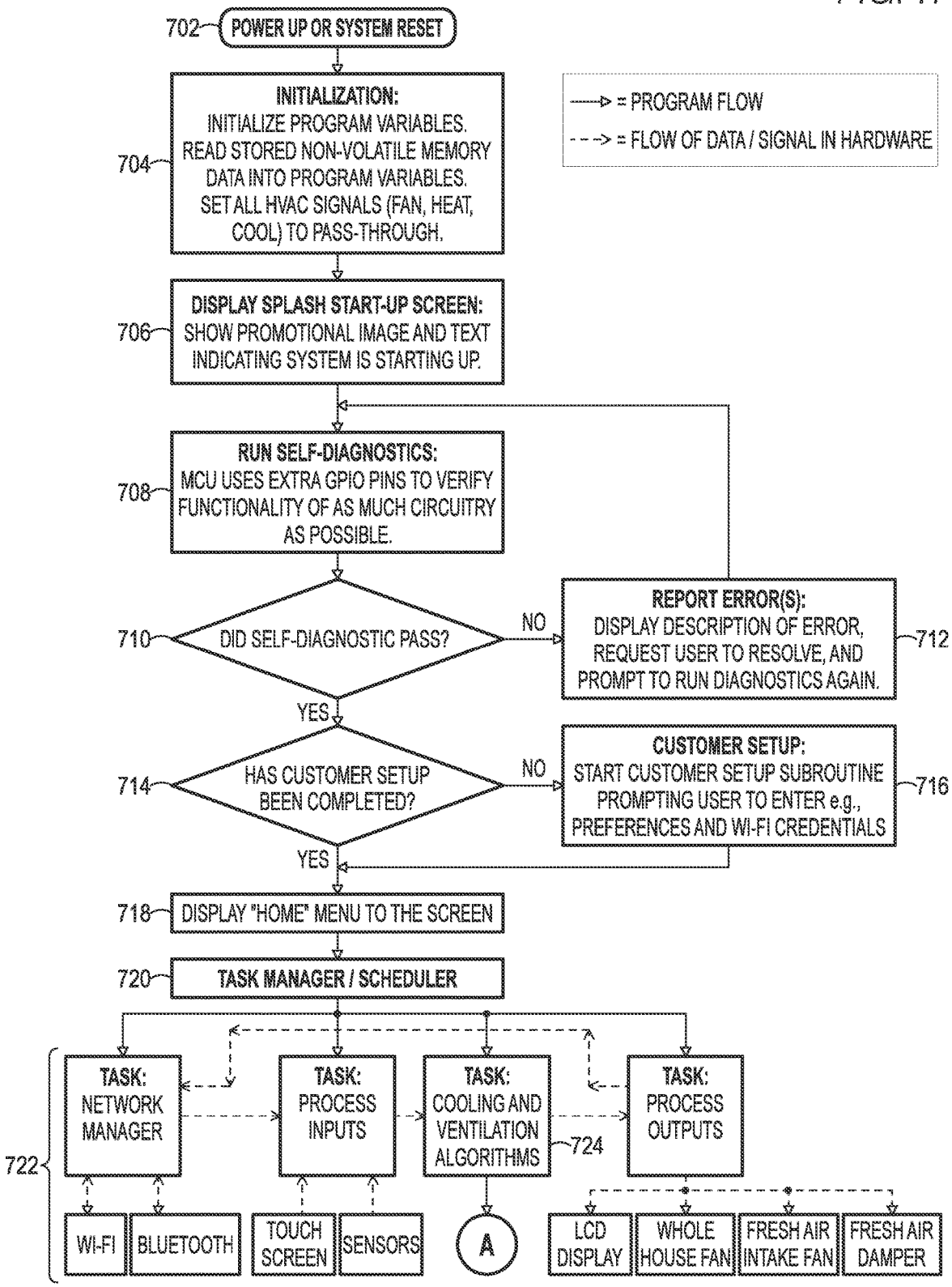
FIGS. 7A-7B represent a flow chart illustrating a non-limiting example operating process of an example embodiment of the FACV controller.
Figure 7B:
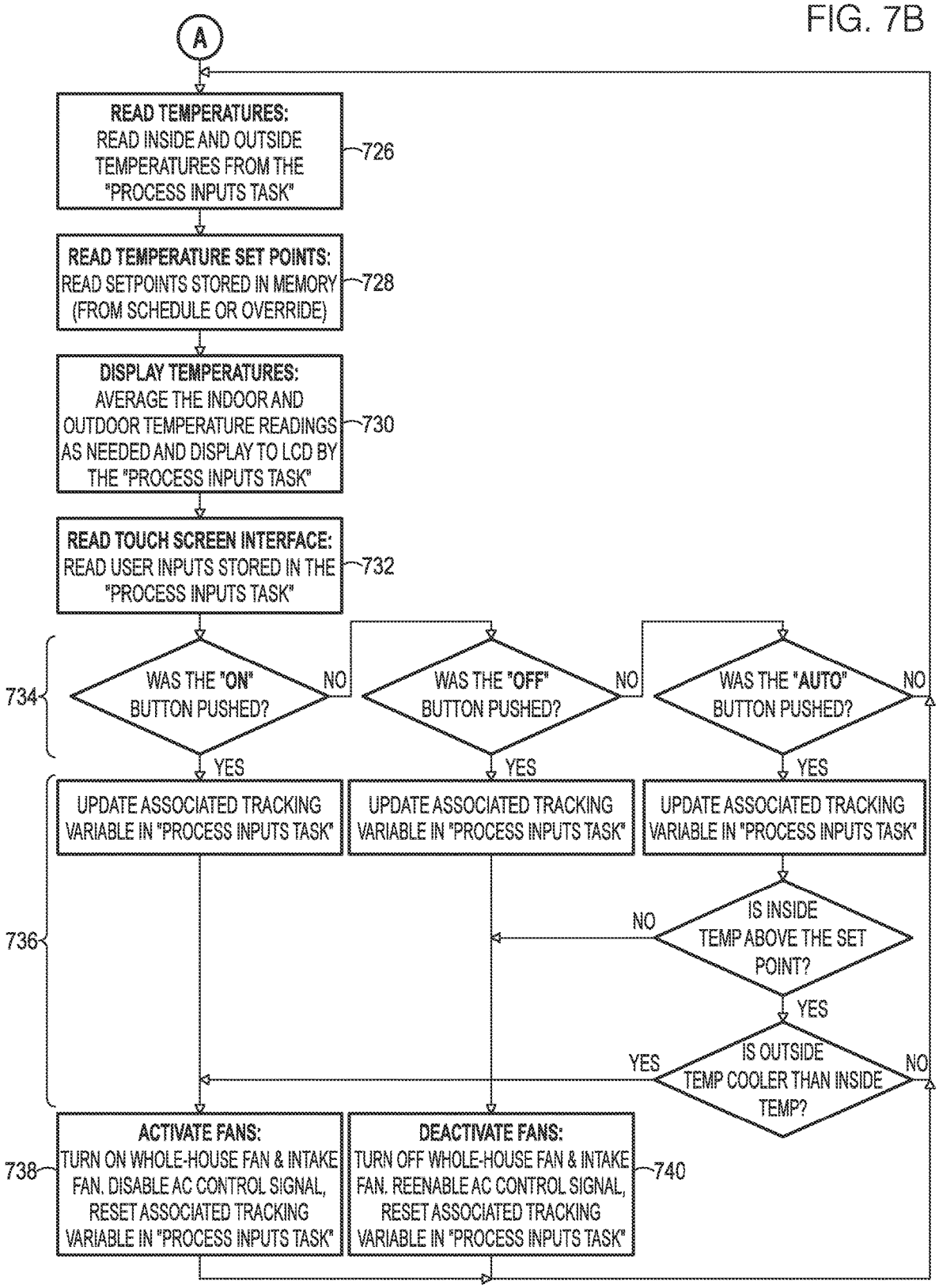

FIGS. 7A-7B represent a flow chart 700 of illustrating an operating process of an example embodiment of the FACV controller 100. The flowchart 700 shows the architecture, functionality, and operation of a possible software implementation for realizing the operation of the FACV controller 100. In this regard, each block may represent a module, segment, or portion of code, which comprises one or more executable instructions for implementing the specified logical function(s). It should also be noted that in some alternative implementations, the functions noted in the blocks may occur out of the order noted in FIGS. 7A-7B, may include additional functions, and/or may omit some functions. For example, two blocks shown in succession in FIGS. 7A-7B may, in fact, be executed substantially concurrently, the blocks may sometimes be executed in the reverse order, or some of the blocks may not be executed in all instances, depending upon the functionality involved. All such modifications and variations are intended to be included herein within the scope of this disclosure.

With respect to FIGS. 7A-7B, the process 700 starts at block 702, for example, in response to the starting, system reset, or powering up of the system, or in response to a signal from a sensor or user interface. At block 704, the FACV controller 100 initializes. At block 706, a startup page may be optionally presented on the touch screen display 106.

At block 708, self-diagnostics are run. At block 710, a determination is made whether the self-diagnostics passed. If not (the NO condition), the process proceeds to block 712, where report errors are presented on the touch screen display 106. Then, the process returns to block 708 to continue the self-diagnostics process after receiving corrective input. If a determination is made at block 710 that the self-diagnostics passed (the YES condition), the process proceeds to block 714.

At block 714, a determination is made whether the resident has completed the setup process. If not (the NO condition), the process proceeds to block 716, where prompts are presented on the touch screen display 106. Then, when the resident input is complete, the process moves to display the home menu at block 718. If a determination is made at block 714 that the setup process has been YES condition), the process proceeds to block 718.

At block 720, the task manager and scheduler routine is initiated. Blocks 722 indicate various tasks and scheduling that the resident may specify via the touch screen display 106. At block 724, the task manager and scheduler routine ends, and the process continues to block 726 (FIG. 7B).

At block 726, inside and outside temperature information is read by the microcontroller 102. At block 728, temperature set points are read. At block 730, the temperature information and the temperature set points, along with other supplemental information (see, for example, FIG. 6), are presented on the touch screen display 106. At block 732, any input by the resident, made via the touch screen display 106 is read and stored.

At blocks 734, a determination is made whether the resident has selected one of the "ON," "OFF," or "AUTO" operating conditions for control of the FACV controller 100. At blocks 736, updates to the process input tasks are saved based on the resident's selection at blocks 734. If the FACV controller 100 is to bring fresh, cool outside air into the residence 400, the various controlled fans are activated at block 738. If the fans are not to be operated to bring in the outside air, then the fans are deactivated at block 740. The process then returns to block 726.

Some embodiments of the FACV controller 100 may be configured to monitor the humidity of the air in the occupied quarters 412 and the outdoor air. If the resident has specified a humidity set point, such embodiments of the FACV controller 100 may be configured to bring in fresh outside air if the humidity of that air is at the specified humidity set point.

Similarly, some embodiments of the FACV controller 100 may be configured to monitor the $CO_2$ level of the air in the occupied quarters 412 and the outdoor air. If the resident has specified a $CO_2$ level set point, such embodiments of the FACV controller 100 may be configured to bring in fresh outside air if the $CO_2$ level of that air is above the specified $CO_2$ level set point (and/or by an optional predefined threshold).

The microcontroller 102 may be implemented as firmware, or a combination of hardware and firmware. When implemented as hardware, microcontroller 102 is constructed with commonly available components well known in the art. For example, but not limited to, microcontroller 102 may be implemented as a suitable configuration of transistors on an integrated circuit (IC) chip. One skilled in the art of designing and implementing state machines will appreciate that many alternative configurations of the components (not shown) residing in an FACV controller 100 may be implemented having the above-described functionality and operation, and that such embodiments are too numerous to conveniently describe in detail herein. Any such implementation of the fresh air cooling and ventilator (FACV) controller 100 is intended to be within the scope of this disclosure and to be protected by the accompanying claims.

The FACV controller 100 has been described herein as being installed in a residence 400. Alternative embodiments may be configured to be installed in other types of structures. For example, embodiments of the FACV controller 100 may be configured to be installed in offices, apartments, or other buildings. As another non-limiting example, embodiments of the FACV controller 100 may be implemented in climate control agriculture buildings.

It should be emphasized that the above-described embodiments of the FACV controller 100 are merely possible examples of implementations of the invention. Many variations and modifications may be made to the above-described embodiments. All such modifications and variations are intended to be included herein within the scope of this disclosure and protected by the following claims.

Furthermore, the disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions, and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower, or equal in scope to the original claims, are to be considered within the subject matter of the inventions described herein.

Therefore, having thus described the invention, at least the following is claimed:

1. A fresh air cooling and ventilator (FACV) system configured to controllably couple to a thermostat, wherein the thermostat has a wall plate secured to a wall, wherein the wall plate has a plurality of wall plate terminals that are disposed on an outside surface of the wall plate, wherein the wall plate terminals connect to control wires that are communicatively coupled to an air handling unit, wherein the thermostat has a cover plate with a thermostat controller therein, wherein the thermostat controller has a plurality of controller connecting terminals on an inside surface of the cover plate that each have a location matching a location of each one of a corresponding one of the wall plate terminals, and wherein the cover plate secures to the wall plate using a cover plate securing means on the inside surface of the cover plate that releasably couples to a wall plate securing means on the outside surface of the wall plate, the FACV system comprising:

an interface member defined by a proximal portion and a distal portion, wherein the proximal portion of the interface member is disposed between the outside surface of the wall plate and inside surface of the cover plate when the FACV system is installed to the thermostat, and wherein the distal portion of the interface member extends outwardly from a side of the thermostat when the FACV system is installed to the thermostat;

a plurality of input connectors disposed on a first side of the proximal portion of the interface member, wherein a location of each one of the plurality of input connectors corresponds to the location of a corresponding one of the plurality of controller connecting terminals of the thermostat controller, and wherein each one of the plurality of controller connecting terminals has a predefined function associated with control of a remote air-handling unit;

a plurality of output connectors disposed on a second side of the proximal portion of the interface member, wherein the first side of the interface member opposes the second side of the interface member, and wherein a location of each one of the plurality of output connectors corresponds to a location of a corresponding one of a plurality of faceplate terminals of the thermostat controller system;

a plurality of switches, wherein each one of the switches is connected between one of the plurality of input connectors and a corresponding one of the plurality of output connectors;

a microcontroller controllably coupled to each one of the plurality of switches;

a first securing means located on the second side of the proximal portion of the interface member, wherein the first securing means couples to the wall plate securing means when the FACV system is installed to the thermostat so that the plurality of wall plate terminals are in electrical contact with the plurality of output connectors; and a second securing means located on the first side of the proximal portion of the interface member, wherein the second securing means couples to the cover plate securing means when the FACV system is installed to the thermostat so that the plurality of controller connecting terminals are in electrical contact with the plurality of input connectors, wherein in response to the thermostat controller system operating during a heating period, the plurality of switches are closed by the microcontroller such that the thermostat controller system controls an operation of the remote air-handling unit that heats air provided to occupied quarters, wherein in response to the thermostat controller system operating during a fresh air cooling period, the plurality of switches are opened by the microcontroller such that the thermostat controller system no longer controls the operation of the remote air-handling unit, and wherein the microcontroller operates a remote fan to draw the outside air into the occupied quarters during at least a portion of the fresh air cooling period.

2. The FACV system of claim 1, wherein in a temperature of outside air is at least less than a cooling set point during the fresh air cooling period.

3. The FACV system of claim 1, wherein in a temperature of outside air is less than an indoor temperature during the fresh air cooling period.

4. The FACV system of claim 1, wherein the remote air-handling unit includes an air conditioning (AC) unit that cools air provided to the occupied quarters, wherein in response to the thermostat controller system operating during the fresh air cooling period, the plurality of switches are closed by the microcontroller such that the thermostat controller system controls the operation of the AC unit in response to the temperature of outside air being greater than the cooling set point, and wherein in response to the thermostat controller system operating during the fresh air cooling period, the plurality of switches are opened by the microcontroller such that the thermostat controller system no longer controls the operation of the air conditioning unit in response to the temperature of the outside air being at least less than the cooling set point.

5. The FACV system of claim 1, wherein the remote air-handling unit includes an air conditioning (AC) unit that cools air provided to the occupied quarters, wherein in response to the thermostat controller system operating during the fresh air cooling period, the plurality of switches are opened by the microcontroller such that the thermostat controller system no longer controls the operation of the air conditioning unit in response to the temperature of the outside air being less than, by a predefined threshold temperature, an inside temperature, and wherein in response to the thermostat controller system operating during the fresh air cooling period, the plurality of switches are closed by the microcontroller such that the thermostat controller system controls the operation of the AC unit in response to the temperature of outside air being greater than the inside temperature.

6. The FACV system of claim 1, wherein the remote fan is a whole-house fan that receives air from the occupied quarters and transfers the received air out into an attic, and further comprising:

a transceiver disposed on the interface member and communicatively coupled to the microcontroller, wherein the transceiver is configured to communicatively couple to a wireless receiver that controls the operation of the whole-house fan, and wherein the whole-house fan operates in response to the wireless receiver receiving a wireless activation signal from the transceiver.

7. The FACV system of claim 1, wherein the remote fan is a fresh air intake fan that receives the outside air and transports the outside air into the occupied quarters via a supply air duct that transports air from the remote air-handling unit to the occupied quarters.

8. The FACV system of claim 7, further comprising:

a transceiver disposed on the interface member and communicatively coupled to the microcontroller, wherein the transceiver is configured to communicatively couple to a wireless receiver that controls the operation of the fresh air intake fan, and wherein the fresh air intake fan operates in response to the wireless receiver receiving a wireless activation signal from the transceiver.

9. The FACV system of claim 7, wherein the fresh air intake fan is a first remote fan, and wherein the microcontroller operates a second remote fan to draw cool outside air into the occupied quarters.

10. The FACV system of claim 9, wherein the second remote fan is a furnace fan.

11. The FACV system of claim 9, wherein the second remote fan is a whole-house fan that receives air from the occupied quarters and transfers the received air out into an attic, and further comprising:

a transceiver disposed on the interface member and communicatively coupled to the microcontroller, wherein the transceiver is configured to communicatively couple to a wireless receiver that controls operation of the whole-house fan, and wherein the whole-house fan operates in response to the wireless receiver receiving the wireless activation signal from the transceiver.

12. The FACV system of claim 1, further comprising:

a touch screen display communicatively coupled to the microcontroller, wherein the touch screen display is disposed on the distal portion of the interface member, wherein the cooling set point is specified by a user operating the touch screen display.

13. The FACV system of claim 1, further comprising:

a transceiver disposed on the interface member and communicatively coupled to the microcontroller, wherein the transceiver is configured to communicatively couple to a smartphone having a touch screen display, and wherein the cooling set point is specified by a user operating the touch screen display of the smartphone.

14. The FACV system of claim 1, further comprising:

a transceiver disposed on the interface member and communicatively coupled to the microcontroller, wherein the transceiver is configured to communicatively couple to an outdoor sensor located outside that is configured to sense temperature of the outside air, and wherein information corresponding to the temperature of the outside air is being received at the transceiver in the FACV system.

15. The FACV system of claim 1, further comprising:

a transceiver disposed on the interface member and communicatively coupled to the microcontroller; and a sensor configured to sense a $CO_2$ level of air in the occupied quarters, wherein the transceiver is configured to communicatively couple to a sensor located outside that is configured to sense the $CO_2$ level of the outside air, wherein information corresponding to the $CO_2$ level of the outside air is received at the transceiver in the FACV system, and wherein the microcontroller operates the remote fan to draw the outside air into the occupied quarters in response to the $CO_2$ level of the inside air being at least above a $CO_2$ level set point, and the $CO_2$ level of the outside air being at least less than the $CO_2$ level set point.

16. The FACV system of claim 1, further comprising:

a temperature sensor disposed on the interface member and communicatively coupled to the microcontroller, wherein the temperature sensor provides temperature information corresponding to the temperature of the air in the occupied quarters, and wherein the microcontroller does not operate the remote fan to draw cool outside air into the occupied quarters in response to the temperature of outside air being greater than the temperature of the air in the occupied space.

17. The FACV system of claim 1, further comprising:

wherein a temperature sensor residing in the thermostat controller system is communicatively coupled to the microcontroller, wherein the temperature sensor provides temperature information corresponding to the temperature of the air in the occupied quarters, and wherein the microcontroller does not operate the remote fan to draw cool outside air into the occupied quarters in response to the temperature of outside air being greater than the temperature of the air in the occupied space.

18. The FACV system of claim 1, further comprising:

a cover member with a cover member perimeter the same as a perimeter of the cover plate, wherein the cover member is disposed between the first surface of the proximal portion of the interface member and the inside surface of the cover plate.

* * * * *